US005752146A

United States Patent [19]

Sato

[11] Patent Number: 5,752,146

[45] Date of Patent: May 12, 1998

[54] ELECTROPHOTOGRAPHIC TYPE IMAGE FORMING DEVICE PROVIDING POSITIVE CHARGE TO TONERS

[75] Inventor: Shougo Sato, Seto, Japan

[73] Assignee: Brother Kogyo Kabushiki Kaisha, Nagoya, Japan

[21] Appl. No.: 760,982

[22] Filed: Dec. 5, 1996

[30] Foreign Application Priority Data

Dec. 8, 1995 [JP] Japan ..... 7-320915
Dec. 28, 1995 [JP] Japan ..... 7-343716

[51] Int. Cl.[6] ..... G03G 15/22; G03G 15/08

[52] U.S. Cl. ..... 399/284; 399/150; 399/357; 430/110; 430/111

[58] Field of Search ..... 399/149, 150, 399/252, 279, 281, 283, 284, 120, 119, 357; 430/100, 105, 109, 110, 111, 120

[56] References Cited

U.S. PATENT DOCUMENTS

| | | | |
|---|---|---|---|
| 4,129,072 | 12/1978 | Fujii et al. | 399/150 X |
| 4,673,631 | 6/1987 | Fukumoto et al. | 430/110 |
| 4,769,676 | 9/1988 | Mukai et al. | 399/150 |
| 4,920,916 | 5/1990 | Mizuno et al. | 399/284 |
| 5,017,962 | 5/1991 | Tsuji et al. | 399/120 |
| 5,045,879 | 9/1991 | Takaoka et al. | 399/149 X |
| 5,338,895 | 8/1994 | Ikegawa et al. | 399/284 X |
| 5,474,869 | 12/1995 | Tomita et al. | 430/111 X |
| 5,497,224 | 3/1996 | Ishikawa et al. | 399/150 X |
| 5,506,665 | 4/1996 | Ishida et al. | 399/119 |
| 5,530,537 | 6/1996 | Thayer | 399/357 |

*Primary Examiner*—Arthur T. Grimley
*Assistant Examiner*—Sophia S. Chen
*Attorney, Agent, or Firm*—Oliff & Berridge, PLC

[57] ABSTRACT

A laser printer performing a developing operation on a positively chargeable photosensitive drum with using positively chargeable toners. The printer includes photosensitive drum, a laser scanner unit for forming an electrostatic latent image on the photosensitive drum, a developing roller for developing the electrostatic latent image by a toner layer consisting of toners having positively chargeable characteristic, a thickness regulation blade for regulating the thickness of the toner layer on the developing roller such that the amount of toners in the toner layer is not more than 0.5 mg/cm$^2$, a scorotoron charger confronting the photosensitive drum in out of contact therefrom for charging the rotating photosensitive drum to the positive polarity, and a transfer roller for transferring the toner image onto a printing sheet. By the thickness regulation of the toner layer, each toner is surely imparted with positive polarity. Residual toners on the photosensitive drum are not deposited on the charger, because the charger is spaced away from the drum.

21 Claims, 6 Drawing Sheets

ELECTROPHOTOGRAPHIC TYPE IMAGE FORMING DEVICE PROVIDING POSITIVE CHARGE TO TONERS

BACKGROUND OF THE INVENTION

The present invention relates to an electrophotographic type image forming device such as a laser printer, a facsimile machine, and a copying machine, and more particularly, to a type thereof having a developing roller and a photosensitive drum.

In a conventional electrophotographic type image forming device, reversal developing operation is widely performed on a negatively charged photosensitive drum having negatively chargeable characteristic with employing negatively charged toner. However, if a widely available scorotoron charger is used so as to negatively charge the photosensitive drum, large volume of ozone will be generated. Further, the generated ozone may degrade the photosensitive member made of organic material and having negatively chargeable characteristic.

With this reason, another image forming device has been provided in which a photosensitive drum having a positively chargeable characteristic is charged by the scorotoron charger in order to reduce amount of ozone generation, and positively charged toners are used for the developing operation.

In the image forming device, strong demand has been made on the improvement on imaging quality. Therefore, in a electrophotographic type image forming device, a given degree of fluidity is required in the toners, so that the toners can be properly subjected to developing, transferring and cleaning on the photosensitive drum. To this effect, generally, toners are added with a silica as additives at a surface of the toner so as to enhance fluidity.

In another aspect, in the conventional electrophotographic type image forming device, in an impression type developing method, an electrically conductive roller formed of an elastic material is used as the developing roller which carries toners, and the developing roller is depressed against the photosensitive drum. Recently, in such type of developing method, R & D activities have been made on the electrophotographic process in an attempt to avoid generation of waste toner in view of ecology. As one example of the process, so called cleaner-less process has been proposed in which residual toners remaining on the photosensitive drum after transfer operation are carried to the developing unit at a proper timing at which charging process and electrostatic latent image forming process are not interrupted, and the residual toners are collected by the developing unit for reuse. According to the cleaner-less process, a conventional cleaning device such as a cleaning blade can be dispensed with, and therefore, can be prevented a damage to the photosensitive drum due to the direct contact of the blade therewith for toner scraping operation. Thus, residual toners can be relatively efficiently returned to the developing unit.

Because of the strong demand in enhancing the imaging quality in the electrophotographic type image forming device, charging process is extremely important capable of properly performing formation of the electrostatic latent image and developing operation. However, in the conventional cleaner-less process, since the residual toners are carried on the photosensitive drum, the residual toners are inevitably passed through a charging position where a charging unit confronts the photosensitive drum. As a result, if a contact type charging unit is used, residual toners may be deposited onto a contacting portion between the charger and the photosensitive drum, which in turn lowers the charging efficiency, to thereby lower the developing efficiency and degrades an output image.

On the other hand, if a charger of non-contact type is used, the above described problem may not occur since the residual toners are not deposited onto the charger in the cleaner-less process. However, in a conventional electrophotographic type image forming device, developing operation is performed by using a photosensitive drum having a negatively chargeable characteristic, negatively chargeable toners and a scorotoron charger which is a typical example of the non-contact type charger. In this case, electrolytic dissociation occurs in air in a space between the charger and the photosensitive drum to generate large amount of ozone. Further, the generated ozone may deteriorate an organic material such as the photosensitive drum having the negatively chargeable characteristic.

SUMMARY OF THE INVENTION

In an impression type developing system in which toners are carried on a surface of the developing roller and a photosensitive drum is in contact with the developing roller, a thickness regulation blade is provided for regulating a thickness of the toner layer carried on the developing roller. In this case, positive charging to the toners is required by the frictional contact between the thickness regulation blade and the toners. However, silica, which is added for improving fluidity of the toner, normally provides a negatively chargeable characteristic, and therefore, the toners may not be charged to positive polarity but may be charged to negative polarity due to the domination of negatively chargeable characteristic of silica.

The toner includes a resin base and the above described external additive provided at the surface of the resin base. The above described unwanted phenomena is due to the fact that, if such toner is sufficiently subjected to friction, chargeable characteristic of the resin is overriding, whereas if friction applied to such toner is insufficient, the chargeable characteristic of the additive formed over the surface of the resin becomes dominant.

That is, in the above phenomena, since the toner layer on the developing roller has a large thickness, every toner does not subjected to sufficient friction by the thickness regulation blade, and as a result, the toners are charged to negative polarity, or amount or percentage of the positively charged toners are insufficient or small among the all toners in the toner layer.

As a result, insufficient developing portion is provided on the photosensitive drum due to the shortage of the positive charging, and consequently, degradation of image such as fogging may occur in an ultimate output image.

It is therefore, an object of the present invention to overcome the above described problems and to provide an improved image forming device capable of forming a high grade image by way of developing operation with using a photosensitive member having a positively chargeable characteristic and using toners having a positively chargeable characteristic.

Another object of the present invention is to provide such image forming device capable of forming a high grade image while restraining generation of ozone as much as possible.

These and other objects of the present invention will be attained by providing an image forming device for forming an image on an image recording medium, the device including a photosensitive member having a positively chargeable characteristic, means for charging the photosensitive member to a positive polarity, means for forming an electrostatic latent image on the photosensitive member charged to the positive polarity, a developing roller for developing the electrostatic latent image into a toner image on the photosensitive member, the toner image being formed by a toner layer consisting of toners, means for regulating a thickness of the toner layer so that the toner layer on the developing roller amounts to not more than 0.5 mg/cm$^2$, and means for transferring the toner image onto an image recording medium. The regulation means and the photosensitive drum rub the toners positioned therebetween for charging the toners to a positive polarity.

In another aspect of the invention, there is provided the photosensitive member, the charging means, the electrostatic latent image forming means, the developing roller, the transferring means, and means for regulating a thickness of the toner layer so that from one to less than two toner particles are deposited in a radial direction of the developing roller. The regulation means and the photosensitive drum rub the deposited toners positioned between therebetween for charging the toners to a positive polarity.

In still another aspect of the invention, there is provided the photosensitive member, the charging means, the electrostatic latent image forming means, the developing roller, means for regulating a thickness of the toner layer, and the transferring means. The regulation means and the photosensitive drum rub the toners positioned therebetween for charging the toners to a positive polarity. The charging means is out of contact from and in confrontation with the photosensitive member at a charging position whereby residual toners remaining on the photosensitive member after the toner transfer onto the image recording medium are carried on the photosensitive member, and the developing roller collects the residual toners after the residual toners carried on the photosensitive member are passed through the charging position.

DETAILED DESCRIPTION OF THE PREFERRED EMBODIMENTS

Figure 1:
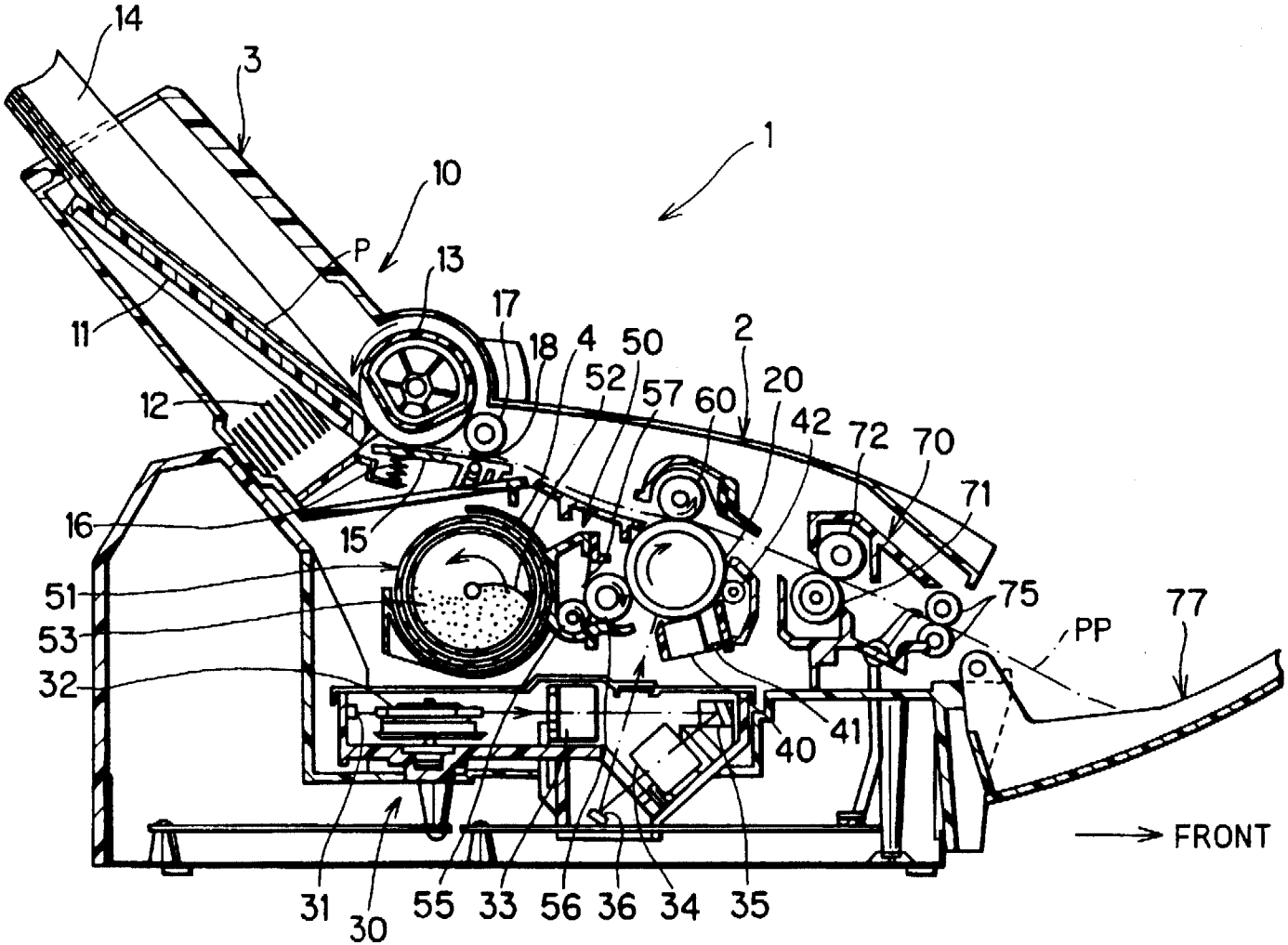
FIG. 1 is a cross-sectional side view showing a laser printer according to one embodiment of the present invention.

An image forming device according to a first embodiment of the present invention will be described with reference to FIGS. 1 through 9, in which a reference is made on a laser printer.

The laser printer includes a case 2, a feed unit 10 for supplying sheets P on which images are to be formed, a photosensitive drum 20 on which exposure, development and transfer process are successively performed for image formation, a fixing unit 70 for fixing an image transferred onto the sheet P from the photosensitive drum 20, and a discharge tray 77 onto which sheets P with the fixed images formed thereon are discharged through a sheet feed passage PP.

The laser printer also provides a driving mechanism (not shown) for drivingly rotating the photosensitive drum 20. Around the photosensitive drum 20, the laser printer 1 further includes, in order along a peripheral surface of the photosensitive drum 20, a laser scanner unit 30, a developing unit 50, a transfer roller 60, a cleaning roller 42, a discharge lamp 41 and a charger 40. The laser scanner unit 30 is adapted for forming the electrostatic latent image on the photosensitive drum 20. The developing unit 50 has a developing roller 56 for developing the electrostatic latent image on the photosensitive drum 20 with positively charged toners. The transfer roller 60 is adapted for transferring the developed toner image on the photosensitive drum 20 into the sheet P. The cleaning roller 42 is adapted for temporarily absorbing residual toners remaining on the photosensitive drum 20 after the transfer operation by the transfer roller 60 in order to return the absorbed toner to the developing unit 50 at a predetermined timing by cooperation with the photosensitive drum 20 in accordance with a cleaner-less system. The discharge lamp 41 is adapted for discharging residual potential remaining on the photosensitive drum 20 after transfer operation. The charger 40 is adapted for charging the photosensitive drum 20 after discharging operation so as to enable the drum to form the electrostatic latent image.

Respective components constituting the laser printer 1 will next be described with reference to FIGS. 1 through 5.

In FIG. 1, the feed unit 10 includes a feeder case 3 disposed at the upper rear end of the case 2. A sheet-pressing plate 11 having a width substantially the same as the width of sheets P is supported within the feeder case 3. The sheet pressing plate has a rearmost edge pivotally supported to the feeder case 3. A compression spring 12 is disposed at the frontmost edge of the sheet pressing plate 11 for resiliently urging the pressing plate 11 upwardly. A sheet-supply roller 13 extending rightward and leftward, that is, in the direction perpendicular to the surface of FIG. 1, is rotatably supported to the sheet pressing plate 11. The driving mechanism (not shown) is also connected to the sheet feed roller 13 for driving the sheet-roller 13 to rotate at a proper sheet supplying timing. A sheet-cassette 14 capable of housing a plurality of stacked sheets cut into a predetermined shape is detachably and slantingly mounted in the case 3. Rotation of the sheet-supply roller 13 supplies an uppermost sheet P of the sheet stack contained in the sheet-supply cassette 14. A separation member 15 for preventing two sheets from being supplied at the same time is provided below the sheet-supply roller 13. A compression spring 16 is provided for resiliently urging the separating member 15 against the sheet-supply roller 13. A pair of resist rollers 17, 18 for aligning the leading edge of supplied sheet P are rotatably provided downstream of the sheet supply roller 13 in a sheet-transport direction.

Figure 2:
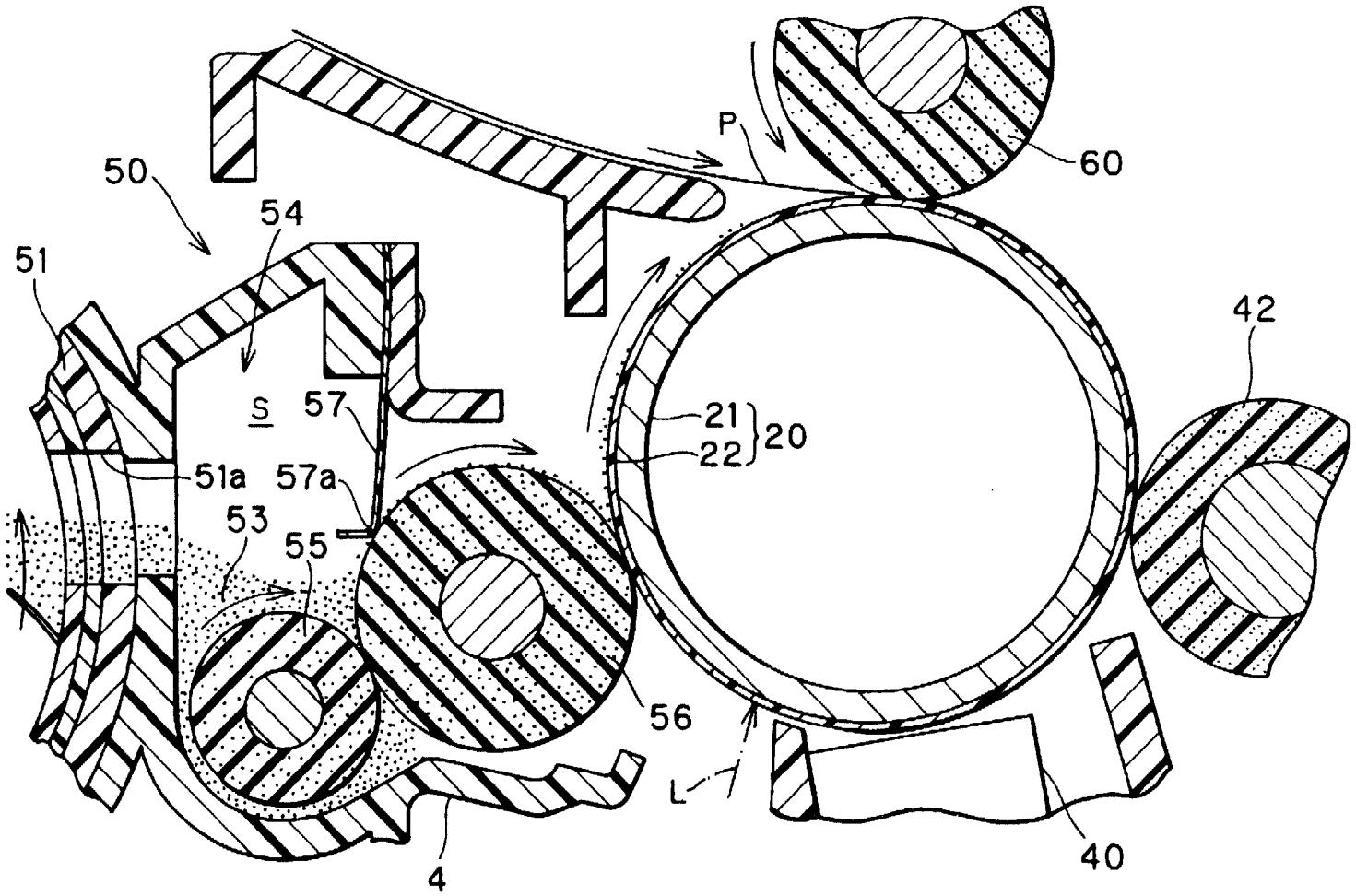
FIG. 2 is an enlarged side view showing details of a developing unit and a photosensitive drum in the laser printer shown in FIG. 1.

In FIGS. 1 and 2, the photosensitive drum 20 is formed of a material having a positively chargeable characteristic. The material is, for example, a positively chargeable organic photosensitive material. More specifically, as shown in FIG. 2, the photosensitive drum 20 includes a hollow cylindrical aluminum sleeve 21 and a photoconductive layer 22 formed to a predetermined thickness, for example, about 20 μm, to the outer peripheral surface of the sleeve 21. The photoconductive layer 22 is made of a poly-carbonate and a photo-conductive resin dispersed therein. The sleeve 21 is rotatably mounted on the case 2 in a grounded condition. With this configuration, developing is possible by reversal development wherein positively charged toner 53 develops a positively charged electrostatic latent image formed on the surface of the photosensitive drum 20. The photosensitive drum 20 is drivingly rotated in a clockwise direction in FIG. 2 by the driving mechanism (not shown).

In FIG. 1, the laser scanner unit 30 is disposed below the photosensitive drum 20 and includes a laser emitting unit 31 for generating the laser light L to form electrostatic latent image on the surface of the photosensitive drum 20, a five-sided polygon mirror 32 driven to rotate, a pair of lenses 33, 34, and a pair of reflection mirrors 35, 36. Because the laser scanner unit 30 is disposed below the photosensitive drum 20, the length of the image forming device in the sheet-transport direction can be reduced, so that the laser printer 1 can be provided in a more compact size. Also, the laser scanner unit 30 can emit the laser light L to form the electrostatic latent image on the surface of the photosensitive drum 20 without interference with the sheets transported in the sheet-transport pathway PP.

The charger 40 is of a scorotoron type charger for generating a corona discharge from a tungsten charge wire. The charger 40 is held out of contact with the photosensitive drum 20. Because the photosensitive drum 20 is made of a material having a positively chargeable characteristic, the charger 40 is imparted with voltage of positive polarity. Further, because the cleaner-less method is applied, an because the charger 40 is out of contact with the photosensitive drum 20, the residual toner on the photosensitive drum 20 are not deposited on the charger 40.

The discharge lamp 41 is provided by a light source, such as a LED (laser emitting diode), an EL (electroluminescence) and a fluorescent lamp. The discharge lamp 41 is adapted for removing residual charge remaining on the photosensitive drum 20 after transfer operation in order to prevent the residual charge from affecting on the a subsequently formed electrostatic latent image, thereby degrading a resultant output image formed on the sheet P.

The cleaning roller 42 is adapted for temporarily absorbing residual toners 53 remaining on the photosensitive drum 20 after transferring operation by changing biasing voltage, and for discharging the absorbed toners 53 to the photosensitive drum 20 at a proper timing at which exposure, developing and transferring operation on the photosensitive drum 20 are not interrupted by the toners, thereby returning the toners from the photosensitive drum 20 to the developing unit 50. The cleaning roller 42 is made of a foamable elastic material having an electrical conductivity such as a silicone rubber and polyurethane rubber to which biasing voltage is applicable.

In FIGS. 1 and 2, the developing unit 50 includes a developing case 4 and a double-cylindrical toner box 51 detachably mounted within the developing case 4. A drivingly rotatable agitator 52 and electrically insulative toners 53 having positively chargeable characteristic are contained in the toner box 51. A toner-supply port 51*a* is formed in the toner box 51. A toner-storage chamber 54 is provided at a front side of the toner box 51 for storing therein the toners 53 supplied from the toner box 51 through the toner-supply port 51*a* by the rotation of the agitator 52. A toner supply roller 55 is rotatably supported in the toner-storage chamber 54 and extends in a horizontal direction. A developing roller 56 is rotatably supported in contact with both the toner supply roller 55 and the photosensitive drum 20. The developing roller 56 extends in the horizontal direction so as to form a front wall of the toner-storage chamber 54.

The toner-supply roller 55 is formed of a foamable elastic material such as silicone rubber and polyurethane rubber having electrical conductivity. A resistance at a portion in contact with the developing roller 56 is set to about $5\times10^{4}$ $1\times10^{9}$ Ohms.

Further, the developing roller 56 has a relatively high hardness and is formed from a silicone rubber or polyurethane rubber having electrical conductive properties. The resistance value from the core electrode, which is applied with a developing bias voltage, to the outer peripheral surface in contact with the photosensitive drum 20 is set to about $5\times10^{4}$ to $1\times10^{7}$ Ohms. The toner supply roller 55 and the developing roller 56 are driven to be rotated in a clockwise direction in FIG. 2 by the driving mechanism (not shown).

The developing roller 56 is adapted for performing developing operation using the tones 53 in co-operation with the photosensitive drum 20, and for collecting the residual toners returned onto the photosensitive drum 20 by the cleaning roller 42. More specifically, provided that the residual toners are carried on the photosensitive drum 20 by an amount of about 10% of entire toner amount used for the transfer operation, and such photosensitive drum 20 carrying the residual toner is exposed to laser beam by the laser scanner unit 30 so that the laser beam sufficiently reaches beneath the residual toners 53. Then, in the developing unit 50, by utilizing potential difference between an exposed portion and non-exposed portion regardless of the existence of the residual toners on the photosensitive drum 20, the residual toners 53 are moved to or collected by the developing rollers 56 if the residual toners 53 are affixed on the non-exposed portion of the photosensitive drum 20. Simultaneously, the residual toners 53 are maintained to be affixed on the photosensitive drum 20 if the residual toners have already been affixed to the exposed portion of the photosensitive drum 20. Concurrently, positively charged toners 53 are moved from the developing roller 56 to the photosensitive drum 20 if the residual toners 53 have not been affixed to the exposed portion of the photosensitive drum 20. That is, developing cycle and toner collecting cycle are performed concurrently.

As shown in FIG. 2, the toner-storage chamber 54 in the developing unit 50 is formed with a relatively large open space S above the toner supply roller 55. Therefore, even when a great deal of toner 53 are supplied from the toner box 51 through the toner-supply port 51*a* into the toner-storage chamber 54, the toners 53 will not become compressed in the toner-storage chamber 54. Therefore, the toners 53 will constantly be in a fluffed condition which can provide sufficient fluidity. This allows the supply roller 55 to stably supply toner.

A resilient thickness-regulating blade 57 formed in a thin-plate shape from stainless steel or phosphor bronze is dependingly attached to the developing case 4. The thickness-regulating blade 57 has a lowermost bending portion 57*a* in pressing contact with the developing roller 56. The thickness-regulating blade 57 regulates thickness of toners 53 supplied from the toner supply roller 55 and adhering to the surface of the developing roller 56 to a predetermined thickness of from one toner particle to less than two particles in the thickness direction of the toner layer, that is, to about 7 to 12 μm thick, which is equivalent to about not more than 0.5 mg/cm$^2$ with respect to the amount of the toners on the developing roller 56. The bent portion 57*a* has a radius of curvature of about 0.3 mm to insure a toner amount of 0.4 mg/cm$^2$. Incidentally, developing bias and rotation number of the developing roller 56 will determine the minimum amount of toners on the developing roller 56. For example, if the toner amount on the developing roller is about 3 mg/cm$^2$, developing operation can be made with a sufficient toner density by using an ordinarily available developing bias and rotation numbers of the developing roller 56.

Figure 3:
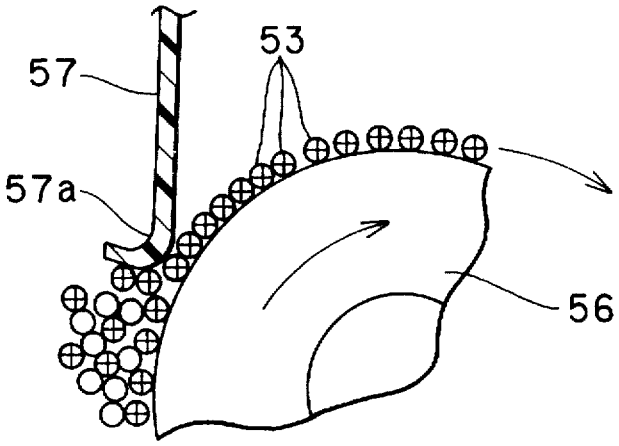
FIG. 3 is an enlarged side view showing details of a developing roller and a thickness regulation blade in the laser printer shown in FIG. 1.

As shown in FIG. 3, on the developing roller 56, since the thickness of the toner layer is regulated by the thickness regulation blade 57 in such a manner that the toner amount on the developing roller is not more than 0.5 mg/cm$^2$, from one to less than two toner particles are stacked on the developing roller in a radial direction thereof to provide the toner layer. As a result, almost all the toners 53 are sufficiently rubbed by the developing roller 56 and the thickness regulation blade 57, and are sufficiently charged. (In FIG. 3, "+" mark is affixed to the toner particles which is indicative of the toners imparted with sufficient charge.) Accordingly, the electrostatic latent image formed on the photosensitive drum 20 is sufficiently developed with the sufficiently positively charged toners 53. Further, since from one to less than two toner particles are stacked on the developing roller in a radial direction thereof to provide the toner layer, the toners 53 which have not been used for the developing operation are not accumulated on the contacting portion between the photosensitive drum 20 and the developing roller 56, but can be collected by the adhesion to the developing roller 56.

The transfer roller 60 is freely rotatably disposed above and in contact with the photosensitive drum 20. The transfer roller 60 is formed from foamable elastic material and having electrical conductivity such as silicone rubber, and polyurethane rubber. The resistance value where the transfer roller 60 contacts the photosensitive drum 20 is set to about $1\times10^6$ to $1\times10^{10}$ Ohms. This resistance value is relatively large so that even though the transfer roller 60 contacts the surface of the photosensitive drum 20, the voltage applied to the transfer roller 60 will not destroy the photoconductive layer 22 formed on the photosensitive drum 20 yet the toner image on the photosensitive drum 20 can be reliably transferred onto the sheet P.

The fixing unit 70 is provided downstream in the sheet-transport direction of the photosensitive drum 20. The fixing unit 20 includes a heat roller 71 housing therein a conventional halogen lamp and a pressing roller 72. A sheet P with the toner image transferred onto its lower surface is heated and pressed between the heat roller 71 and the pressing roller 72 so that the toner image is fixed onto the sheet P.

A pair of transport rollers 75 and the discharge tray 77 are provided downstream in the sheet-transport direction from the fixing unit 70. In the depicted embodiment, as shown in FIG. 1, the sheet roller 30, the photosensitive drum 20, the fixing unit 70, and the discharge tray 77 form a substantially linear sheet transport pathway PP along which sheets P supplied from the sheet supply cassette 14 are transported.

Figure 5:
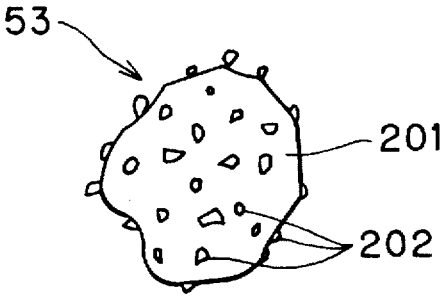
FIG. 5 is a schematic perspective view showing a toner used in the laser printer shown in FIG. 1.

The toner 53 is a non-magnetic and single component type toner. The toner is formed of polymerized material such as styreneacryl, which may be pulverized toner or a spherically shaped toner. Particle size of the toner 53 is in a range of from 6 to 12 μm. As shown in FIG. 5, the toner 53 includes a base toner 201 and the additive 202 added to the base toner 201. Silica is used as the additive for imparting the resultant toner with fluidity. The base toner 201 contains resin, wax, carbon black and CCA (charge control agent such as nigrosine and triphenylmethane). The resultant toner has positively chargeable characteristic by the function of CCA. Silica which is the example of the additives is a surface quality changing agent of the toner in order to enhance fluidity of the toner 53, and generally has negatively chargeable characteristic. Even though amino-deformation silica is known as a silica having positively chargeable characteristic, the positively chargeable silica generally provides insufficient fluidity. Accordingly, negatively chargeable silica having low polarity is often used as the additive. If charging amount is positively increased by the addition of a silica to the base toner, the silica is the positively chargeable silica, and if charging amount is negatively increased by the addition of a silica to the base toner, the silica is the negatively chargeable silica.

If the toner is subjected to sufficient friction by the thickness regulation blade 57 and the developing roller 56, the charging characteristic of the CCA contained in the base toner 201 becomes dominant, so that the toner 53 is charged to the positive polarity based on the charging characteristic of the base toner 201. On the other hand, if the toner 53 is insufficiently rubbed, the charging characteristic of the silica 202 which is exposed to the surface of the base toner 201 becomes dominant, so that the toner 53 is charged to negative polarity based on the charging characteristic of the silica 202.

Further, the additive can be provided with toner blocking preventing function, cleaning enhancement function, less damaging function to the photosensitive drum, image density improving function, and image quality improving function in addition to the enhancement of fluidity. Minute powders of colloidal silica, titanium oxide, and aluminum oxide (alumina) are available as additives other than silica. However, the present embodiment is advantageous in that not only the positively chargeable additives but also negatively chargeable additives can be used. Incidentally, particle size of the base toner 201 is in a range of from 6 to 12 μm, whereas particle size of silica 202 is in a range of from 10 to 30 nm. Therefore, in fact, silica 202 is extremely smaller than base toner 201 in comparison with the illustration shown in FIG. 5.

Operation of the laser printer 1 will next be described with reference to FIGS. 1, 6 through 9.

Figure 6:
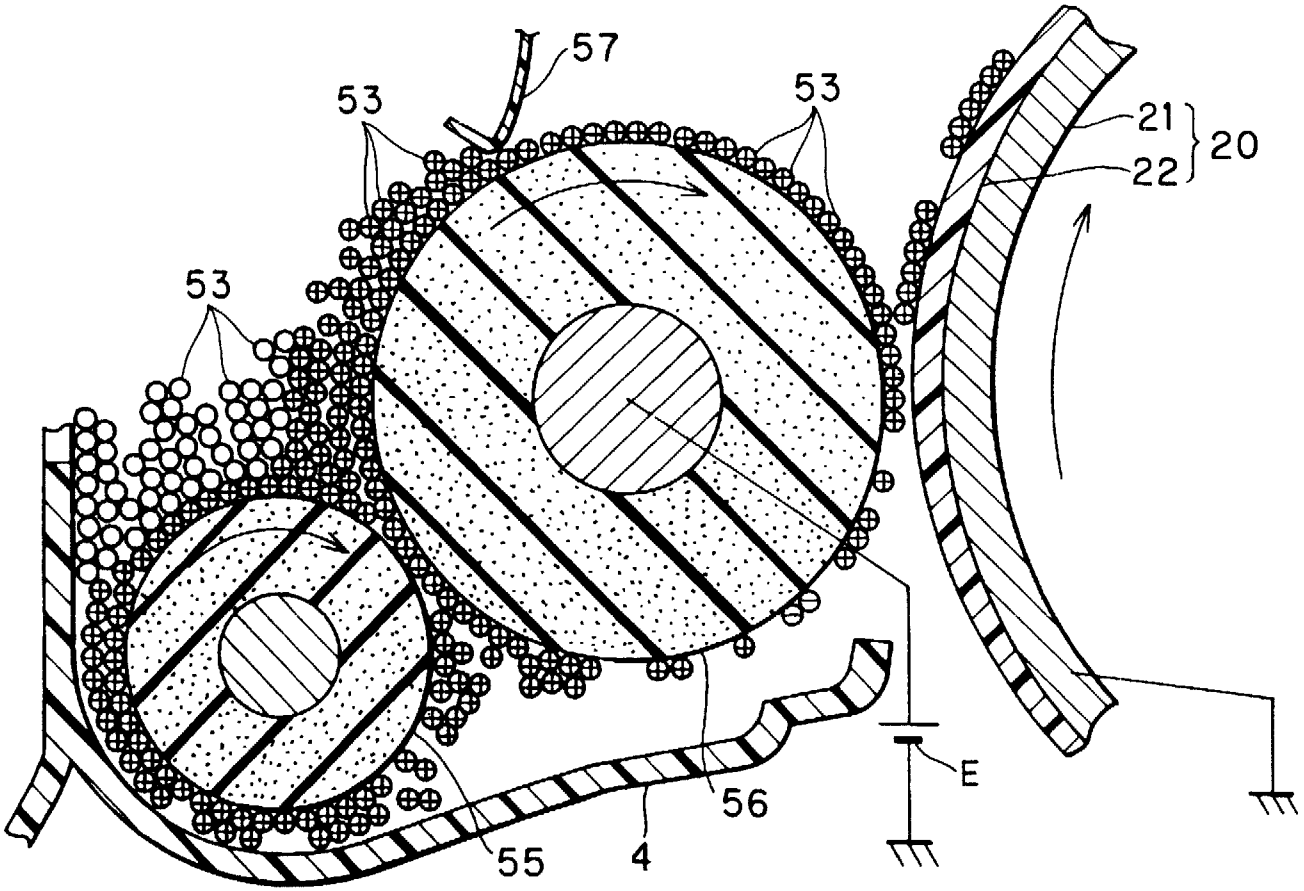
FIG. 6 is an enlarged side view showing the developing unit of the laser printer shown in FIG. 1

In FIG. 1, the photosensitive drum 20 is driven to be rotated in the clockwise direction by the driving mechanism (not shown). Also, the toner supply roller 55 and the developing roller 56 are driven to be rotated in the clockwise direction. With this configuration, as shown in FIG. 6, the toner supply roller 55 and the developing roller 56 scrape against each other. Also, the thickness-regulating blade 57 pressingly abrades against the developing roller 56. The scraping and abrading action positively charges individual toner 53. The positively charged toner 53 adheres to the electrostatic latent image formed on the surface of the photosensitive drum 20 by the laser beam L, thereby performing reversal developing.

As described above, the toner layer provided on the developing roller 56 by the thickness regulation blade 57 has toner amount of not more than 0.5 mg/cm$^2$. Therefore, from one to less than two toner particles are deposited on the developing roller 56 in the radial direction thereof in the toner layer. Accordingly, almost all the toner 53 undergo sufficient friction by the developing roller 56 and the thickness regulation blade 57, so that the toners 53 can be sufficiently positively charged. Consequently, the electrostatic latent image on the photosensitive drum 20 can be sufficiently developed with the sufficiently charged toners 53.

Figure 7:
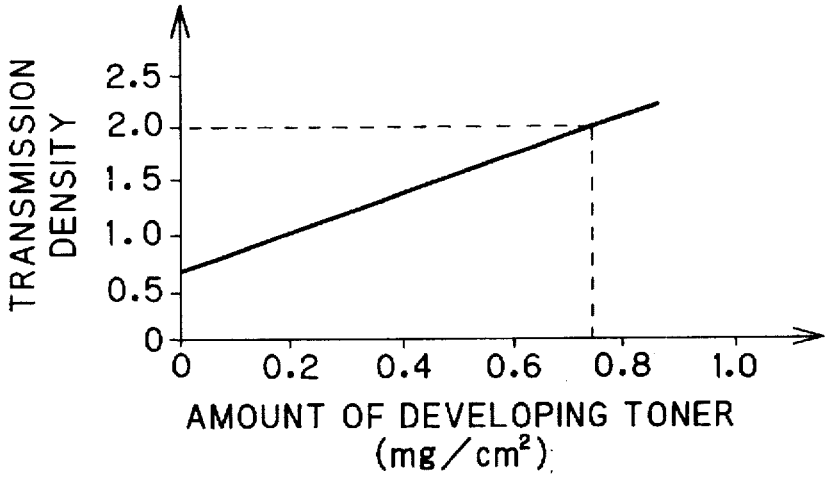
FIG. 7 is a graph showing the relationship between transmission density and amount of developing toner in the laser printer shown in FIG. 1.

As shown in FIG. 7, in order to obtain a transmission density (image density) of 2.0, the amount of toner adhering to the surface of the sheet needs to be about 0.78 mg/cm$^2$. It should be noted that when the thickness-regulating blade 57 regulates the toner amount on the developing roller 56 to 0.4 mg/cm$^2$ as described above, a development efficiency is set to slightly less than 100 percent, and peripheral velocity of the developing roller 56 is set twice as high as the peripheral velocity of the photosensitive drum 20. That is, at the nip portion, direct contact between the developing roller 56 and the photosensitive drum 20 is avoided, yet small amount of toners 53 can remain on the developing roller 56 by the Van der Waals attraction.

Figure 8:
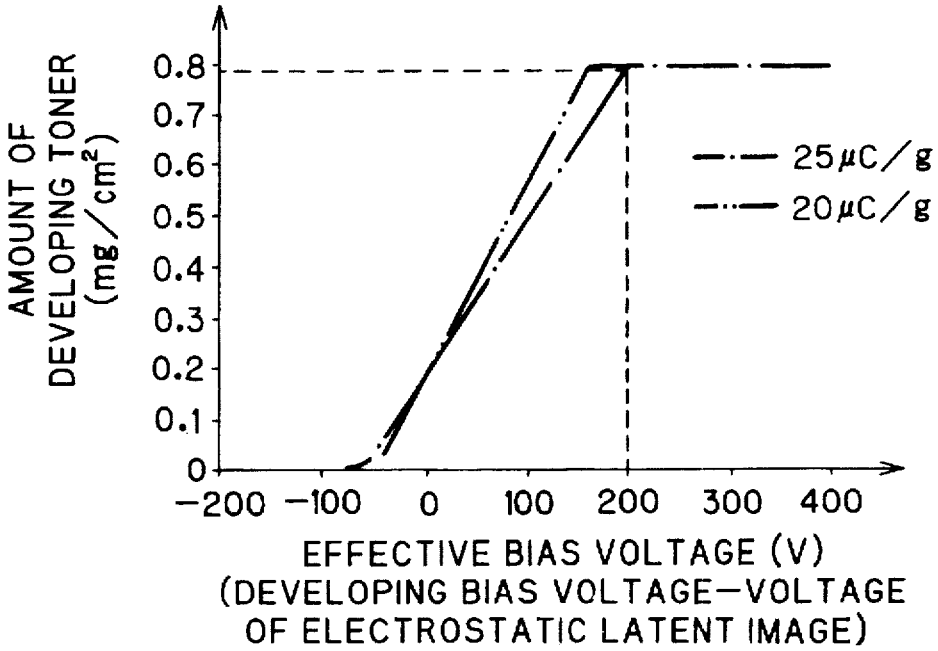
FIG. 8 is a graph showing the relationship between amount of developing toner and an effective bias voltage in the laser printer shown in FIG. 1.

The charging amount of the toner 53 depends on the temperature and humidity of the ambient environment. For example, in a low temperature and a low humidity environment of 10 degrees C. and 20 percent humidity, the charge amount can be about 25 μC/g. This can decrease to about 20 μC/g at high temperature and high humidity conditions of about 32 degrees C. and 80 percent humidity. As shown in FIG. 8, in order to obtain the predetermined developing toner amount of approximately 0.78 mg/cm$^2$ in the low temperature and low humidity environment as indicated by the one-dot chain line or in the high temperature and high humidity environment as indicated by the two-dot chain line, under the condition that the developing roller 56 is driven in the same rotational direction as the photosensitive drum 20, the effective developing bias voltage of the developing roller 56 needs to be set to about 200 volts. Because the voltage of the electrostatic latent image formed on the surface of the photosensitive drum 20 is about 100 volts, the developing bias voltage of a power source E for applying voltage to the developing roller 56 is set to 300 volts.

Figure 9:
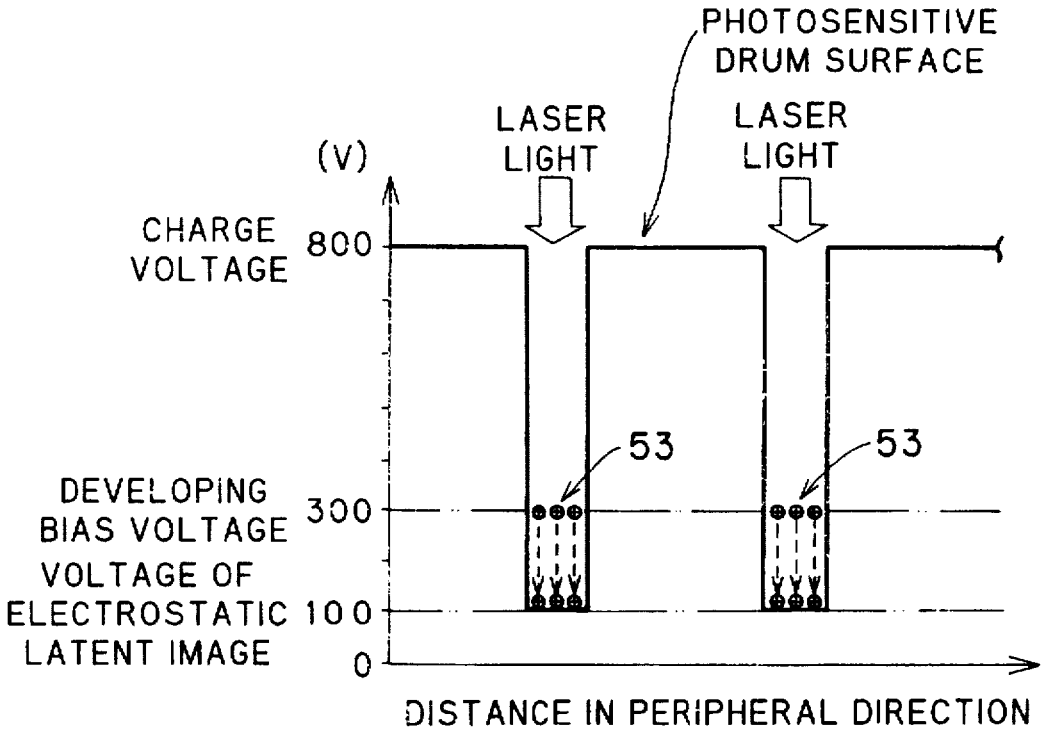
FIG. 9 is a graphical representation for description of voltage level in each developing section according to the reversal development in the laser printer shown in FIG. 1.

When image forming processes are started under the above described set voltage, any charges remaining on the surface of the photosensitive drum 20 are removed by the discharge lamp 41. Then, as shown in FIG. 9, the charger 40 applies a uniform charge of about 800 volts to the surface of the photosensitive drum 20.

The laser emitting unit 31 emits a laser beam L, which is scanned in a main scanning direction by the polygon mirror 32. The laser beam L then irradiates the surface of the photosensitive drum 20, after passing through the lenses 33, 34 and reflecting off the reflecting mirror 35, 36, to form the electrostatic latent image on the surface of the photosensitive drum 20. Voltage at the surface of the photosensitive drum 20 formed with the electrostatic latent image drops to about 100 volts as shown in FIG. 9.

Because positively charged toners 53 are adhering in a thickness of from one particle to less than two particles in the radial direction of the developing roller 56, while a developing bias voltage of about positive 300 volts is applied to the developing roller 56, the toner 53 is attracted to the voltage lower then itself, that is, to the electrostatic latent image voltage, which is about positive 100 volts, rather than to the high charge voltage of about 800 volts at areas other than the electrostatic latent image. Therefore, the toner 53 from the developing roller 56 are moved to only a portion where the electrostatic latent image is formed on the surface of the photosensitive drum 20. Thereby producing a visible toner image.

The toner image formed by developing the electrostatic latent image using toner 53 is transferred to the sheet P by the transfer roller 60. Afterward, the toner image is fixed to the sheet P by the fixing unit 70 and discharged onto the discharge tray 77. As mentioned above, the sheet-transport pathway PP through which the sheet P supplied from the sheet-supply cassette 14 is transferred is approximately linear in shape. Therefore, an accurate and clean toner image can be formed even on thick sheets P such as envelopes, postcards and OHP films.

On the other hand, in FIG. 1, the residual toners 53 remaining on the photosensitive drum 20 due to non-transfer to the sheet P when the sheet P is moved past the transfer roller 60 are temporarily absorbed to the cleaning roller 42 by changing biasing voltage of the cleaning roller 42. The temporarily absorbed toners 53 are then released from the cleaning roller 42 to the photosensitive drum 20 by changing the biasing voltage of the cleaning roller 42 at a proper timing at which subsequent exposure, developing and transfer operation are not interrupted by the toner releasing. Then the residual toners 53 on the photosensitive drum 20 are collected by the developing roller 56 and are subjected to recycling.

Figure 4:
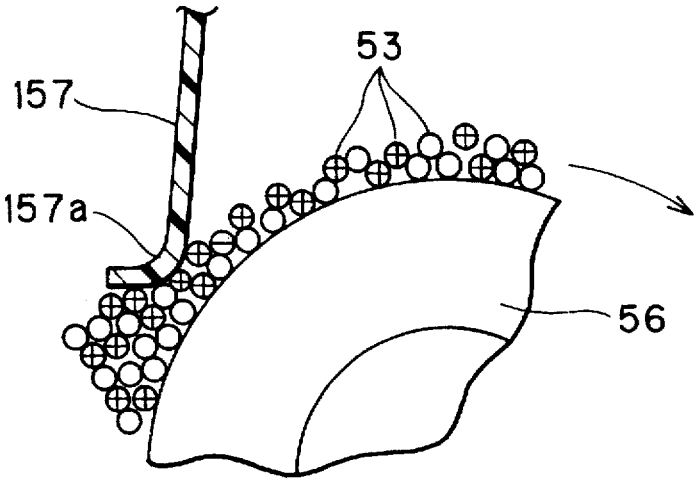
FIG. 4 is an enlarged side view showing details of a developing roller and a thickness regulation blade in a comparative example.

FIG. 4 shows a developing unit according to a comparative example. A toner layer is provided by a thickness regulation blade 157 having a bending portion 157*a* whose radius of curvature is greater than that of the bending portion 57*a* of the thickness regulation blade 57 according to the first embodiment. The bending portion 157*a* is adapted for providing the toner layer having a toner amount of more than 0.5 mg/cm$^2$ on the developing roller 56. In FIG. 4, the thickness of the toner layer on the developing roller 56 is such that not less than two toner particles are deposited on the developing roller 56 in a radial direction thereof. Accordingly, in the comparative example, because the toners 53 on the developing roller are not sufficiently rubbed by the developing roller 56 and the thickness regulation blade 157, large volume of toners 53 have not been sufficiently charged. (In FIG. 4, similar to FIG. 3, "+" mark is affixed to the toner particles which is indicative of the toners imparted with sufficient charge.) The electrostatic latent image on the photosensitive drum 56 cannot be sufficiently developed with the insufficiently charged toners 53. Accordingly, printing defect such as fogging may be generated in the final output image. Particularly, if the toners 53 contain the additives having negatively chargeable characteristic such as silica, the toners which have not been sufficiently rubbed by the developing roller 56 and the thickness regulation blade 57 may become toners having reverse characteristic (negative polarity). Thus, excessive printing defect such as fogging results.

Figure 10:
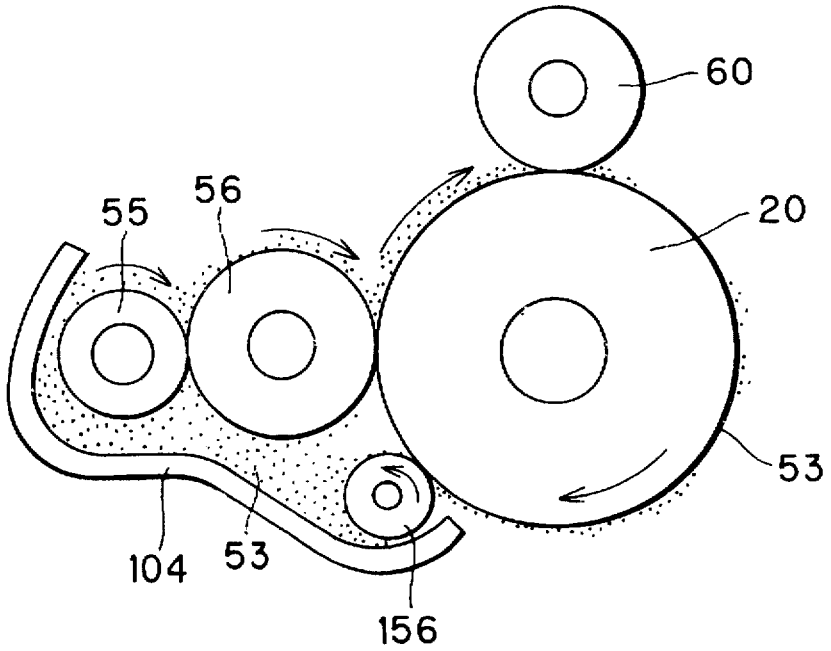
FIG. 10 is an enlarged side view showing details of a photosensitive drum and a developing unit according to a second embodiment of the present invention.

FIG. 10 shows a modified arrangement of a developing unit. In the modification, a toner collection roller 156 is provided at a position beside the developing roller 56 and at a position close to the laser scanner unit 30 for exclusively collecting the residual toners 53. In this case, the developing roller 56 is adapted for exclusively performing developing operation. Further, in this case, a developing case 104 is shaped such that the residual toners 53 collected by the toner collection roller 156 can be fed toward the toner supply roller 55 and the developing roller 56 by the rotation of the toner collection roller 156. In this modified embodiment, the collection roller 156 is exclusively used for collecting the residual toners. Therefore, the residual toners can surely be collected with relatively simple construction.

In the laser printer 1 according to the foregoing embodiments, the developing operation is performed on the positively charged photosensitive drum 20 by using the non-magnetic, single component type and positively chargeable toners 53 containing negatively chargeable silica additives. Here, the thickness of the toner layer on the developing roller 56 is regulated by the layer thickness regulating blade so that the layer amounts to not more than 0.5 mg/cm$^2$. Accordingly, from one toner particle to less than two particles are deposited on the photosensitive drum in a thickness direction of the toner layer. Consequently, almost all the toners are sufficiently subjected to friction by the developing roller and the thickness regulation blade, and are sufficiently charged to positive polarity. Therefore, the electrostatic latent image on the photosensitive member is sufficiently developed with the sufficiently charged toners. As a result, printing defect such as fogging can be reduced, and high quality image can be provided. Further, because positive charging is performed by the scorotoron charger, ozone generation amount can be reduced.

Further, in the laser printer 1 according to the depicted embodiment, despite of the fact that the residual toners 53 are carried in accordance with the rotation of the photosensitive drum 20, the residual toners 53 are not deposited onto the charger 40, because the charger 40 confronting the photosensitive drum 20 is out of contact with the photosensitive drum 20. Accordingly, charging performance of the charger 40 is not lowered. Consequently, high quality image can be formed on the sheet P. Further, the photosensitive drum is relatively easily charged to positive polarity by the scorotoron charger. Further, generation amount of ozone due to electrolytic dissociation of the air between the charger 40 and the photosensitive drum 20 can be reduced to one tenth in comparison with a case where the photosensitive member is charged to negative polarity by the scorotoron charger.

Further, developing and toner collecting operation can be performed by the single roller. Therefore, compact developing unit results, and collection of the residual toners by the cleaner-less method can be achieved efficiently. Further, in this case, by performing the developing and collecting operation at independent cycle, collection of the residual toners can be carried with a relatively simple construction under the cleaner-less method. On the other hand, the developing and collecting operation can be performed almost concurrently in the same cycle. With such an arrangement, entire operation period can be shortened. Thus, image forming operation can be performed rapidly.

While the invention has been described in detail and with reference to the specific embodiments thereof, it would be apparent to those skilled in the art that various changes and modifications may be made therein without departing from the spirit and scope of the invention. For example, in the above described embodiment, the cleaning roller 42 is provided in order to efficiently perform the cleaner-less type toner collection. However, instead of the cleaning roller 42, or in addition thereto, a cleaning brush to which a biasing voltage is applied can be provided so as to level the residual toners on the photosensitive drum 20.

Further, in the illustrated embodiment, nonmagnetic, single component type toners are used. However, two components type toners or magnetic toners are also available as far as the toners are chargeable to positive polarity and the positively chargeable photosensitive drum is employed.

Furthermore, in the depicted embodiment, a drum shaped photosensitive member is used. However, a belt shaped photosensitive member is also available as far as it is formed of the positively chargeable material.

As an further alternative of the developing unit 50, the developing cycle and the toner collection cycle can be performed at different timing, and biasing voltage applied to the developing roller 56 relative to the photosensitive drum 20 is changed at every cycle. For example, in the developing cycle, developing bias voltage is applied so that the positively charged toners 53 are moved (developed) from the developing roller 56 to the exposed area of the photosensitive drum 20, and in the collection cycle, collection bias voltage is applied so that the residual toners 53 are moved (collected) from the photosensitive drum 20 to the developing roller 56. In this way, various arrangement can be used so as to collect residual toners in the developing unit 50 using the developing roller 56.

Moreover, the above description concerns formation of a monochromatic image. However, color image formation is also available in the above described embodiment. Further, in the depicted embodiment, the developing roller 56 and the photosensitive drum 20 are rotated in the same direction (these are moved in opposite directions at the confronting contacting surfaces). However, these rollers can be rotated in the opposite rotating direction (these are moved in the same direction at the contacting surfaces). Furthermore, the illustrated embodiment is arranged so as to collect the residual toners for recycling. For recycling the toners, the developing roller 56 etc. is effectively functioned in a case where a cleaning device having a cleaning blade is provided, or toners are returned from the cleaning device to the developing unit 50 by using a toner transport spring.

Further, the illustrated embodiment pertains to the laser printer. However, the present invention can be applied to a copying machine and a facsimile machine those being an electrophotographic type image forming device using toners.

What is claimed is:

1. An image forming device for forming an image on an image recording medium comprising:

a photosensitive member having a positively chargeable characteristic;

a charger charging the photosensitive member to a positive polarity;

an electrostatic latent image forming unit for forming an electrostatic latent image on the photosensitive member charged to the positive polarity;

a developing roller for developing the electrostatic latent image into a toner image on the photosensitive member, the toner image being formed by a toner layer consisting of toners;

a thickness regulator for regulating a thickness of the toner layer so that from one to less than two toner particles are deposited in a radial direction of the developing roller, the thickness regulator and the developing roller rubbing the deposited toners positioned therebetween for charging the toners to a positive polarity; and a transfer roller for transferring the toner image onto an image recording medium.

2. The image forming device as claimed in claim 1, wherein the thickness regulator regulates the thickness of the toner layer so that the toner layer on the developing roller amounts to not more than 0.5 mg/cm$^2$.

3. The image forming device as claimed in claim 2, wherein the toners are made of a non-magnetic single component type toner.

4. The image forming device as claimed in claim 3, wherein the toners comprise: a base having a positively chargeable characteristic, and an additive formed over an outer surface of the base and having a negatively chargeable characteristic.

5. The image forming device as claimed in claim 4, wherein each toner has a particle size in a range of from 6 to 12 μm.

6. The image forming device as claimed in claim 4, wherein the thickness regulator means comprises a layer thickness regulation blade provided with a bending portion, the bending portion being disposed in contact with the developing roller.

7. The image forming device as claimed in claim 6, wherein the thickness regulation blade is made of a resilient material.

8. The image forming device as claimed in claim 7, wherein the bending portion has a radius of a curvature of 0.3 mm.

9. The image forming device as claimed in claim 8, further comprising a developing case for rotatably installing therein the developing roller, the thickness regulation blade is dependingly attached to the developing case.

10. The image forming device as claimed in claim 9, wherein the charger comprises a scorotoron charger.

11. The image forming device as claimed in claim 10, wherein the developing roller is made of a material selected from the group consisting of silicone rubber and polyurethane rubber.

12. The image forming device as claimed in claim 9, further comprising a toner box detachably mounted within the developing case;

a toner supply roller rotatably supplied in the developing case and in contact with the developing roller;

an agitator drivingly rotatable in the toner box.

13. The image forming device as claimed in claim 2, wherein the charger is out of contact from and in confrontation with the photosensitive member at a charging position whereby residual toners remaining on the photosensitive member after the toner transfer onto the image recording medium are carried on the photosensitive member, and the developing roller collects the residual toners after the residual toners carried on the photosensitive member are passed through the charging position.

14. The image forming device as claimed in claim 13, further comprising a toner collection roller for exclusively collecting the residual toners on the photosensitive member, the developing roller exclusively performing developing operation.

15. The image forming device as claimed in claim 14, wherein the toner collection roller is positioned upstream of the charger for temporarily absorbing residual toners before the residual toners reach the charging position, and for discharging the temporarily absorbed toners onto the photosensitive member at a predetermined timing.

16. The image forming device as claimed in claim 15, wherein the toner collection roller is formed of a foamable elastic material having an electrical conductivity.

17. The image forming device as claimed in claim 13, further comprising:

a developing case in which the developing roller is installed;

a toner supply roller disposed in the developing case for supplying the toners to the developing roller: and a toner collection roller disposed in the developing case for collecting residual toners on the photosensitive member and delivering the collected residual toners toward the toner supply roller.

18. An image forming device for forming an image on an image recording medium comprising:

a photosensitive member;

a charger for charging the photosensitive member;

an electrostatic latent image forming unit for forming an electrostatic latent image on the charged photosensitive member;

a developing roller for developing the electrostatic latent image into a toner image on the photosensitive member, the toner image being formed by a toner layer consisting of toners, the photosensitive member and the developing roller being in nipping relation with each other at a nipping point, and the rotating direction of the developing roller being the same as the rotating direction of the photosensitive member so that the outer peripheral surfaces of said developing roller and said photosensitive member move in opposite directions at said nipping point;

a thickness regulator for regulating a thickness of the toner layer, the thickness regulator and the developing roller rubbing the toners positioned therebetween for charging the toners; and a transfer roller for transferring the toner image onto an image recording medium, the charger being out of contact from and in confrontation with the photosensitive member at a charging position whereby residual toners remaining on the photosensitive member after the toner transfer onto the image recording medium are carried on the photosensitive member, and the developing roller collects the residual toners after the residual toners carried on the photosensitive member are passed through the charging position.

19. The image forming device as claimed in claim 18, further comprising a cleaning roller positioned in confrontation with the photosensitive member for temporarily absorbing the residual toner on the photosensitive member into the cleaning roller and then returning the absorbed residual toner from the cleaning roller to the photosensitive member at a predetermined timing by changing biasing voltage applied to the cleaning roller.

20. An image forming device for forming an image on an image recording medium comprising:

a photosensitive member having a positively chargeable characteristic;

a charger charging the photosensitive member to a positive polarity;

an electrostatic latent image forming unit for forming an electrostatic latent image on the photosensitive member charged to the positive polarity;

a developing roller for developing the electrostatic latent image into a toner image on the photosensitive member, the toner image being formed by a toner layer consisting of toners and the toners comprising spherically shaped polymerized toners;

a thickness regulator for regulating a thickness of the toner layer, the thickness regulator and the developing roller rubbing the toners positioned therebetween for charging the toners to a positive polarity; and a transfer roller for transferring the toner image onto an image recording medium, the charger being out of contact from and in confrontation with the photosensitive member at a charging position whereby residual toners remaining on the photosensitive member after the toner transfer onto the image recording medium are carried on the photosensitive member, and the developing roller collects the residual toners after the residual toners carried on the photosensitive member are passed through the charging position.

21. The image forming device as claimed in claim 20, wherein each toner contains silica as additive.

* * * * *